US005834903A

United States Patent [19]

Christian

[11] Patent Number: 5,834,903

[45] Date of Patent: Nov. 10, 1998

[54] DOUBLE RESONANT DRIVER BALLAST FOR GAS LAMPS

[75] Inventor: David A. Christian, Fort Wayne, Ind.

[73] Assignee: Marshall Electric Corporation, Rochester, Ind.

[21] Appl. No.: 801,881

[22] Filed: Feb. 18, 1997

Related U.S. Application Data

[63] Continuation-in-part of Ser. No. 488,853, Jun. 9, 1995, abandoned, which is a continuation-in-part of Ser. No. 144,661, Oct. 28, 1993, abandoned.

[51] Int. Cl.[6] ..... H05B 41/36

[52] U.S. Cl. ..... 315/219; 315/225; 315/308; 315/257; 315/276; 315/291

[58] Field of Search ..... 315/307, 308, 315/219, 225, 257, 276, 291

[56] References Cited

U.S. PATENT DOCUMENTS 4,916,362 4/1990 Orenstein ..... 315/219
5,041,763 8/1991 Sullivan et al. ..... 315/176
5,315,214 5/1994 Lesea ..... 315/209 R
5,386,181 1/1995 Orenstein ..... 315/287

*Primary Examiner*—Arnold Kinkead
*Attorney, Agent, or Firm*—Harrison & Egbert

[57] ABSTRACT

A power supply device for a gas filled arc-type lamp having a transformer with a core with a primary coil and a secondary coil, a power source coupled to the primary coil of the transformer core and providing a generally sinusoidal signal, a connector for joining the secondary coil of the transformer to the gas-filled arch-type lamp, and an unbalanced capacitance for introducing even-order harmonic distortion on the generally sinusoidal signal on the primary coil of the transformer and generating a generally sinusoidal signal on the secondary coil of the transformer such that a flow of ionized gas is created within the gas-filled arch-type lamp for dispersing any bubbles and standing waves in the lamp and so as to avoid adjustment of the power supply. The distorted signal has one-half cycle longer with a lower peak voltage than the other half-cycle.

9 Claims, 3 Drawing Sheets

DOUBLE RESONANT DRIVER BALLAST FOR GAS LAMPS

RELATED APPLICATIONS

The present application is a continuation-in-part of U.S. patent application Ser. No. 08/488,853, filed on Jun. 9, 1995, and entitled "DOUBLE RESONANT DRIVER BALLAST FOR GAS LAMPS", now abandoned, which is a continuation-in-part of U.S. patent application Ser. No. 08/144,661, filed on Oct. 28, 1993, and entitled "DOUBLE RESONANT DRIVER BALLAST FOR GAS LAMPS", now abandoned.

BACKGROUND OF THE INVENTION

1. Field of the invention

The present invention relates to electronic ballast circuitry, and, more particularly, to ballast circuits for driving gas filled arc type lamps.

2. Description of the Related Art

Gas filled arc type lamps, e.g., neon lamps, require high voltage input signals for proper operation. Such lamps are commonly driven by output transformer ballast inverters. Electronic ballast circuits generally include a transformer and oscillation device which accept an input power source and operate to alter the input power source to provide a high frequency, high voltage output having proper characteristics to drive the gas filled arc type lamp load. Electronic ballast circuits utilize electronic switches in the form of transistors to satisfy the high frequency requirement, typically controlled by pulse width modulation. The transistors are connected to operate in a push/pull mode, providing a high frequency oscillating signal. High frequency operation provides the advantage of reduced power consumption by way of improved lighting efficiency and reduced power dissipation in the ballast.

The voltage outputs of prior art ballast designs may rise to potentially hazardous levels in the event of a fault condition, for example an overvoltage input or circuit energization across an open load. Under such circumstances, prior art circuits may suffer internal damage. Prior art ballast control circuitry for gas filled arc type lamps typically derives power directly from the input power source, resulting in unnecessary power consumption and heat build up. Another potential problem traditionally associated with ballast circuits involves the squealing and humming caused by internal circuit electronic interferences.

Standing wave patterns or "bubbles" are a problem associated with gas filled arc type lamps. The power supplied to the lamp resonates and causes zones of the gas inside the lamp tubing to become ionized, with the length of the ionized zones being related to the speed of sound inside the lamp and the internal geometry of the lamp tubing. This resonant condition results in the dark and light zones in the gas filled lamp which appear as "bubbles" visible to the human eye.

Certain prior U.S. patents have issued relating to the present invention. For example, U.S. Pat. No. 4,682,082, issued on Jul. 21, 1987, to MacAskill et al. teaches a gas discharge lamp that includes a transformer with a substantially rectangular hysteresis loop. A secondary winding on the transformer is connected to energize the lamp and at least one primary winding is provided on the transformer. At least one semi-conductor, such as a transistor, is connected to the input terminals and to at least one primary winding, and a control means is provided for the semi-conductor for unequal on and off conduction periods of the semi-conductor. These unequal periods provide conditions which eliminate striations or dark spots in the gas plasma of the lamp. This imbalance is introduced through a biasing difference between the driver transistors. As such, the circuit of the MacAskill patent leads to one half-cycle being longer with a higher peak than the other half cycle. This condition leads to DC bias being introduced across the tube. This produces a condition that causes mercury migration in a tube doped with mercury. Since the MacAskill circuit utilizes square waves that contain odd-order harmonics, the square waves can cause a significant amount of radiated interference. The MacAskill circuit is suitable only for neon gas tubes, not for either neon gas tubes doped with mercury or other gases doped with mercury.

U.S. Pat. No. 5,367,224, issued on Nov. 22, 1994, to D. Pacholok describes a high frequency luminous tube power supply having neon-bubble and mercury-migration suppression. The suppressor of this patent incorporates a transformer, the primary of which serves as the conventional series input choke. A parasitic damping resistor and diode are connected in series with the transformer secondary and this series combination is, in turn, connected across the DC supply source for the oscillator. The transformer turns-ratio is selected such that no current flows through the series secondary under normal operating conditions. Under the generation of a low frequency parasitic oscillation, a current is caused to flow through the secondary including the parasitic damping resistor thereby dampening the parasitic oscillation while maintaining normal high frequency operations. This device lacks DC blocking and tends to require many added electronic devices. Even small imbalances in the duty cycle of the dispersion circuitry switching action will bring about DC lamp current imbalances at the output terminals so as to cause mercury migration.

U.S. Pat. No. 3,778,677, issued on Dec. 11, 1973 to R. P. Criege teaches an inverter ballast circuit somewhat similar to U.S. Pat. No. 4,682,082. This device utilizes an additional secondary winding to raise both filaments of the fluorescent lamp to a high voltage AC above the ground plane of the battery. This induces ionization inside the lamp tube by capacitive coupling to the ground plane, and permits more prompt initiation of the discharge in the lamp.

Circuitry is needed which provides a voltage limited output to prevent damage or injury caused from operation in open or short circuits.

Another need is to monitor the output for operation into impermissible loads and shut down the system operation upon the occurrence of such conditions.

Another need is for an inverter which substantially eliminates electronic interference and thereby eliminates the squeal and hum associated with such gas filled lamps.

Another need is for an output signal that automatically disperses "bubbles" or visible standing waves when the lamp is illuminated without the need of operator adjustment.

Another need is for a control circuit which reduces power consumption and temperature rise.

SUMMARY OF THE INVENTION

The present invention provides a fullwave push/pull double parallel resonant inverter circuit for use as a gas filled arc type lamp driver ballast. The inverter circuit provides a high voltage, high frequency, low current output signal to drive the gas filled lamp load and disperse standing wave patterns, or "bubbles". The inverter is comprised of a control section which derives its power from a secondary winding opposite the in-line transformer DC power supply inductor choke which supplies a reduced level power supply to the control circuit to reduce power consumption and eliminate unnecessary temperature rises. The inverter control section is comprised of an op-amp circuit which provides an input undervoltage lockout section, an excess primary overvoltage lockout, and a major output current imbalance lockout to self-protect the device against faulty operation. These and other features of circuit allow its use with a great range of arc type lamps without requiring special installation measurements and adjustments. The design includes the following functional sections: DC power source, start-up bias, control circuit power source, oscillator control circuit, output transformer section, and load side signal balancing section.

The DC power section accepts a standard 120 VAC, 60 Hz power source. This signal is rectified through a fullwave bridge rectifier in parallel with a filter capacitor such that a rectified filtered DC power source is supplied to the start-up bias section. The start-up bias section comprises a large value resistor used to develop the start-up bias for the control circuitry. As opposed to traditional electronic ballast circuits which drive the oscillator control circuitry source directly from the DC supply, in this instance approximately 150 V, the present invention includes a secondary winding opposite the series current choke inductor which provides a biased DC source of 10 V to 15 V. This biased DC control circuit power source greatly reduces temperature rise and power consumption. The control circuit power source drives the op amp devices and the switching transistors.

The present invention provides for the dispersion of standing waves, thereby eliminating the degradation of the lamp appearance caused by unsightly gas bubbles. Standing wave and bubble dispersion is achieved by introducing an even order harmonic distortion on the generally sinusoidal signal on the primary coil of the transfer and generating a generally sinusoidal distorted signal on the secondary coil of the transformer such that a flow of ionized gas is created within the lamp. The distorted signal has one-half cycle longer with lower peak voltage than the other half-cycle. Due to the sensitive nature of the gas, a constant flow of ionized gas is achieved. Even order harmonic distortion may be accomplished by several means, including, but not limited to, using a capacitor or inductor in parallel with the primary output transformer winding resulting in an unbalanced conductance with respect to the tap of the primary. This unbalancing of the admittance on the primary side has the effect of "moving" the bubbles along through the lamp rendering such bubbles invisible to the human eye. The type or shape of the tube is determinative of the degree of harmonic distortion required to sufficiently disperse the problematic standing waves. The present invention is configured to provide proper dispersion over a wide variation in lamp tube design.

The present invention features a quad op amp device which provides an input undervoltage lockout, excess primary voltage lockout, and a major output current imbalance lockout. The input undervoltage lockout device disables the circuit by preventing the switching transistors from switching to a conducting state and thereby prevents current flow through the inverter. The excess primary voltage lockout senses the current allowed through the Zener diode voltage clamp and, upon sensing an excessive level, resets the control circuit, thereby placing the switching transistors in a non-conducting state. The major output current imbalance lockout senses the input and output sides of the transformer, and shuts down the switching transistors when insufficient power is delivered to the output side.

One embodiment of the invention provides a resistor between the center tap of the output winding and the internal circuit ground which is monitored by an op amp. When the secondary load becomes imbalanced, current flows through the resistor. As the imbalance increases, the voltage across the resistor rises and, upon attaining a prescribed level, the circuit sets the lockout circuit, thereby placing the switching transistors in a non-conducting state.

The present invention provides for enhanced voltage limited operation. If the voltage level across the primary exceeds a certain level, the series zener diode voltage clamp conducts and connects the path to circuit ground. This clamp current is monitored and an excessive level sets the control circuitry. Due to the tight coupling of the primary and secondary windings in the current fed ballast and the use of the balancing capacitors, the output voltage accurately reflects that of the primary winding. By limiting the primary side voltage, the circuit correspondingly limits the output voltage.

The use of a longer half cycle with a lower peak than the other half cycle will serve to maintain nearly equal volt-seconds between the two half-cycles. As such, mercury migration in tubes doped with mercury can be avoided.

The present invention also provides reduced electrical interference. Due to the high frequency nature of the device, the output lamps tend to stay at least partially ionized through both halves of each cycle. This results in less arcing noise, less arc establishment noise, less broad band static, and less radiated noise.

The high voltage circuitry of the present invention is encased in a dense, resilient, hydrophobic compound which exhibits superior high voltage and high frequency insulation characteristics.

One object of the present invention is to provide a voltage limited inverter with a performance characteristic resulting in a voltage limited output.

Another objective of the invention is to provide monitoring and safety disabling capabilities in the event of impermissible loads, input undervoltage start-up lockout, and current limiting overvoltage shunting in order to reduce damage potential.

Another object of the invention is to provide reduced temperature rise and power consumption and therefore a more efficient lighting circuit.

Another object of the invention is to provide the end user with simplicity and increased safety in operation.

It is another object of the present invention to provide a circuit which prevents mercury migration in such tubes.

Another object of the invention is to significantly reduce electrical interference in the form of noise and standing waveforms.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates preferred embodiments of the invention, in two forms, and such exemplification is not to be construed as limiting the scope of the invention in any manner.

DETAILED DESCRIPTION OF THE INVENTION

The preferred embodiments disclosed below are not intended to be exhaustive or limit the invention to the precise forms disclosed in the following detailed description. Rather, the embodiments are chosen and described so that others skilled in the art may utilize their teachings.

Figure 1:
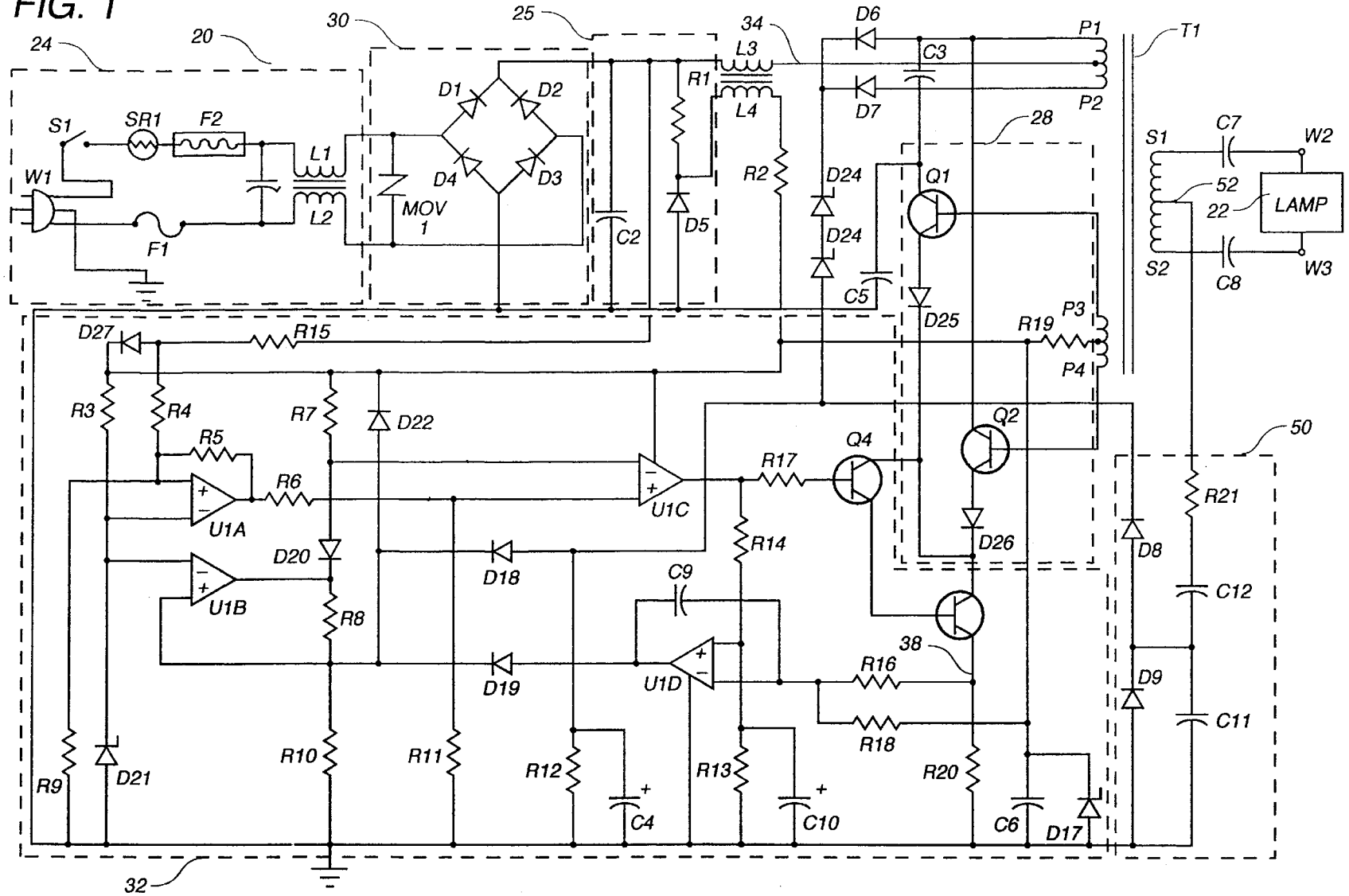
FIG. 1 is a schematic circuit diagram of a first embodiment of the neon driver ballast circuitry.

FIG. 1 schematically illustrates a first embodiment of neon driver ballast 20 in which tuned transformer T1 delivers a sufficient high frequency AC output across contact points W2 and W3 to excite the neon or other gas in discharge lamp 22. Neon driver ballast 20 consists of DC power source 24 having start-up section 26, high frequency series push-pull inverter circuit 28, and transformer T1 consisting of primary windings P1 and P2, secondary windings S1 and S2, and feedback windings P3 and P4.

DC power source 24 derives its power from standard 120 VAC 60 Hz power source W1. On/off switch S1 energizes and de-energizes electronic ballast system. DC power source 24 additionally consists of surge inrush current limiter SR1, low frequency filter capacitor C1, over temperature fuse F1, serpentine fuse F2, and inductors L1 and L2. Full wave bridge rectifier circuit includes a bridge circuit formed of diodes D1–D4 and MOV1, which is connected across the AC main as a protection device to guard against voltage spikes. Rectifier circuit 30 in conjunction with capacitor C2 provides a rectified and filtered DC power source to drive inverter transformer T1. Start-up section 26 includes capacitor C2, resistor R1, and diode D5. This input rectifier and filter arrangement provides DC voltage and blocks reverse conduction of high frequency noise. The resulting DC output of the full wave bridge rectifier is approximately 150 V.

Inductor L3 is placed in series with DC power source 24 and serves as a DC current choke to primary windings P1 and P2 of transformer T1. Rather than feed control circuitry 32 directly with DC power source 24 of approximately 150 V, secondary choke winding L4 is utilized to generate a DC bias voltage of 10 V to 15 V. Stepping down from 150 V to the range of 10 V to 15 V serves to lower the 15 to 25 watts of control bias normally required down to 3 to 4 watts thereby conserving power and reducing temperature rise. Start-up bias resistor R1 develops the start-up bias for control circuitry 32. Inductor L3 also provides a current source along path 34.

Inductor L3 feeds DC supply current to primary windings P1 and P2, providing a high impedance, a low DC resistance, and a filtering function in conjunction with capacitor C2. Accordingly, resonant switching wave forms are not allowed into the main supply. Capacitor C5 provides an unbalanced capacitance with respect to tap 36 of the primary winding, as will be discussed in detail below.

Control circuitry 32 is comprised primarily of op amps U1A, U1B, U1C, and U1D which serve as an input undervoltage lockout, a set/reset flip/flop device, an unbalance current lockout, and an impermissible load lockout. Undervoltage lockout op amp U1A prevents system operation until main DC supply 24 reaches a sufficient level to drive ballast system 20. Until such time driver U1C is in an "off" state providing no bias current to the Darlington pair Q3 and Q4. By depriving the Darlington circuit of sufficient bias current, current is not allowed to pass from collector through emitter of transistors Q3 and Q4 and consequently current is not allowed to flow through the inverter circuit. Op amp U1D acts as an impermissible load sensor and, in conjunction with current sensing resistor R20, de-energizes the control circuit in the event of insufficient delivered load power by setting the flip/flop circuit of op amp U1B. By setting op amp U1B, switching transistors Q3 and Q4 are deprived of sufficient bias current along current path 34 to drive switching transistors Q3 and Q4 to their respective conducting states. By placing switching transistors Q3 and Q4 in their respective nonconducting states, current is not allowed to flow through collector to emitter of the switching transistors thereby precluding primary winding current flow through the current path 38.

Push/pull full wave oscillator 28 comprises oscillation transistors Q1 and Q2. Oscillation transistors Q1 and Q2 act in a push/pull manner with feedback windings P3 and P4 to provide an oscillation feedback signal inversely corresponding to the voltage apparent at primary windings P1 and P2. This feedback signal alternatively switches power transistors Q1 and Q2 to their respective conducting states, thereby alternately allowing primary winding current to pass through collector to emitter. Diodes D6 and D7 rectify the voltage signal produced by primary windings P1 and P2, and zener diodes D23 and D24 act as an overvoltage clamp. If the voltage across the primary windings exceeds the threshold limit of the zener diode series combination D23 and D24, then these devices will conduct and allow current to flow through to circuit ground. In series with zener diodes D23 and D24 is resistor R12. Should the current through resistor R12 exceed a predetermined voltage level, then op amp U1B is triggered and the flip/flop circuit is set.

The frequency of push/pull fullwave oscillator 28 is determined by primary side capacitor C3 in parallel with the primary windings. These elements acting in parallel resonate the collectors of oscillator transistors Q1 and Q2. Primary windings P3 and P4 provide feedback to the bases of oscillator transistors Q1 and Q2. Secondary windings S1 and S2 provide high voltage sine waveform to output resonating capacitors C7 and CB and the load, lamp 22, at outputs W2 and W3. Resonating capacitors C7 and C8 also act as ballasting reactances for the load, and provide blocking of direct and low frequency alternating current to the load. Output windings S1 and S2 are connected in series to resonating capacitors C7 and C8 and in series with the load resulting in gas discharge lamp 22 being an element in the resonant ballast circuit with the resonating capacitors C7 and C8 tuning the output frequency.

Transformer T1 is comprised of windings P1 through P4, S1 and S2, and a ferrite core possessing characteristics such that the primary and secondary windings are tightly coupled resulting in a double parallel resonant circuit. This tight coupling allows for reliable sensing of the secondary load conditions at the primary winding.

In order to avoid the formation of bubbles within the gas filled tubes, that is to avoid degrading the appearance of the lamps due to standing waveforms, an even order harmonic distortion is introduced to the output waveform. This is achieved by causing an imbalance on the primary windings of transformer T1. This imbalance can be created by any of several different means including but not limited to: clipping, clamping, and alternating voltages. In the preferred embodiment, capacitor C5 connected between the primary windings and common achieves the desired unbalancing. This imbalance results in distorted sine waves. One half-cycle will be slightly longer with slightly lower peak voltage than the other half-cycle. This results in similar distortion in the current flowing through gas discharge lamp 22 at W2 and W3. The gas inside the tube is very sensitive to this distortion such that it results in a constant flow of ionized gas toward one end or the other. This flow disperses standing waves and serves to inhibit the formation of bubbles within the lamp tube.

The distorted sine waves in which one half-cycle is slightly longer with slightly lower peak voltage than the other half-cycle is achieved in the circuit in accordance with the following mathematic proof with transistor Q1 conducting and transistor Q2 cut-off, the resonant frequency of the transformer T1 is given by:

$$\omega \approx \left[ \left( C3 + \frac{N_s^2}{N_p^2} \quad \frac{C7 \times C8}{C7 + C8} \right) L_p \right]^{-1/2} \tag{1}$$

During the half-cycle when transistor Q1 is cut-off and transistor Q2 is conducting, capacitor C5 (connected in shunt across transistor Q1) adds to the capacitance of capacitor C3 across the primary winding of transformer T1. The resonant frequency now approximates to:

$$\omega \approx \left[ \left( C3 + C5 + \frac{N_s^2}{N_p^2} \quad \frac{C7 \times C8}{C7 + C8} \right) L_p \right]^{-1/2} \tag{2}$$

Thusly, the resonant frequency for this half-cycle is lower than the previous half-cycle frequency. The time for the half-cycle with transistor Q1 cut-off is longer than the half-cycle with the Q2 cut-off.

In a like manner, the resonant tank of L3-T1-C3-C5-C7-C8 has a fairly high Q such that the stored energy ($E_{tank}$) contained in the inductances and capacitances will be very close to equal from one half-cycle to the other. The peak voltage at the collector of transistor Q2 during cut-off will approximate to:

$$V_p(Q2) \approx \sqrt{2}\ E_{tank}^{1/2} \left( C3 + \frac{N_s^2}{N_p^2} \quad \frac{C7 \times C8}{C7 + C8} \right)^{-1/2} \tag{3}$$

Also, the peak voltage across transistor Q1 during cut-off will approximate to:

$$V_p(Q2) \approx \sqrt{2}\ E_{tank}^{1/2} \left( C3 + C5 + \frac{N_s^2}{N_p^2} \quad \frac{C7 \times C8}{C7 + C8} \right)^{-1/2} \tag{4}$$

As a result, the peak voltage across transistor Q1 is lowered by capacitor C5 compared to the peak voltage across transistor Q2. Mathematically, the above shows that the longer half-cycle is associated with the lower peak voltage, and the shorter half-cycle has the higher peak voltage.

Figure 3:
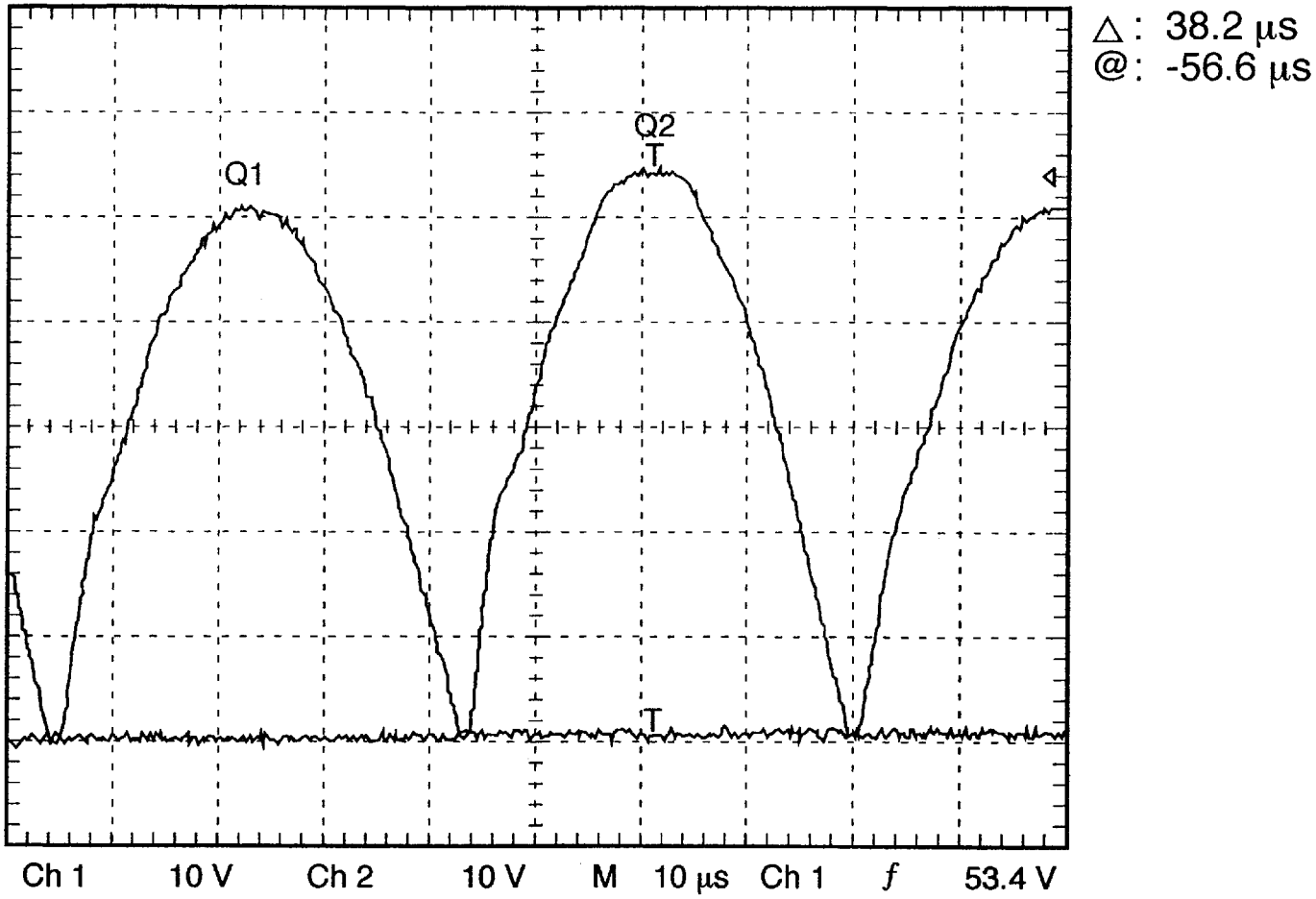
FIG. 3 shows the distorted signal on the secondary side of the transformer.

In order to prevent mercury migration in mercury-doped lamps, it is necessary to create the imbalance so as to maintain nearly equal volt-seconds between the two half-cycles. This imbalance is created from the introduction of an even-order harmonic period. Capacitor C5 in FIG. 1 is connected in shunt from the collector of transistor Q1 to a circuit common. When transistor Q1 is in saturation, capacitor C5 is effectively short-circuited. When transistor Q1 is off, capacitor C5 is effectively connected in parallel with capacitor C3. By this means, the resonating capacitor C3 across the primary of transformer T1 can have different value of tuning capacitance on alternating half-cycles. Thusly, this method leads to the creation of a longer half-cycle with a lower peak than the other half-cycle (see FIG. 3.).

The present invention employs a self-starting Royer oscillator. As such, no capacitor is required to provide an initiating current pulse to the circuit. Also, it has been experimentally discovered that no mercury migration occurs in lamps driven from capacitively DC-blocked supplies of linearized LC resonant Royer oscillator type, as in the present invention. The use of a single part, exemplified in capacitor C5, effects dispersion while accommodating output DC blocking capacitors of whatever size may be required.

Secondary side load current imbalance monitoring circuit 50 includes capacitor C11 and C12, diodes D8 and D9, and resistor R21. Capacitors C11 and C12 and resistor R21 are coupled between center tap 52 of secondary windings S1 and S2 and circuit ground. If the load is reasonably balanced, e.g., plus or minus 20% with respect to circuit ground, then insufficient. current flows through resistor R21 to develop sufficient voltage to set op amp U1B. In the event of a major current imbalance, resistor R21 generates sufficient voltage to set op amp U1B. Once op amp U1B is set, the power transistor arrangement of high frequency oscillation circuit 28 is placed in a nonconducting state thereby disallowing current flow through the primary windings.

The high voltage components are encased in a dense, resilient, hydrophobic compound exhibiting superior high voltage and high frequency insulation characteristics. In the exemplary embodiment, the encasing compound is polyurethane based potting compound.

The following is a list of component parts used in the neon driver ballast circuit as embodied in FIG. 1.

Table Of Component Values Used In FIG. 1

| SYMBOL | VALUE |
|---|---|
| DI–D4 | 800 V, 3A |
| D5, D25–D26 | 100 V, 1A (Fast) |
| D6–D7 | 800 V, 1A (Fast) |
| D17 | 24 V, 1W, 5% Zener |
| DB, D9, D18–D20, D22, D27 | 100 V, 0.1A |
| D21 | 5.1 V, 1/2W, 5% Zener |
| D23, D24 | 300 V Zener |
| C1 | 0.47 uF |
| C2 | 220 uF |
| C3 | 18 nF |
| C4 | 1.0 uF |
| C5 | 4.7 nF |
| C6 | 220 uF |
| C7–8 | 100 pF |
| C9–10 | 1 uF |
| C11 | 0.027 uF |
| C12 | 3300 pF |
| R1 | 47 KΩ |
| R2 | 2.7Ω |
| R3, R17 | 10 KΩ |
| R4–R7, R8–R12 | 100 KΩ |
| R13 | 12 KΩ |
| R14 | 780 KΩ |
| R15 | 1.2 MΩ |
| R16 | 1.8 KΩ |
| R18 | 1 MΩ |
| R19 | 240Ω |
| R20 | 0.47Ω |
| R21 | 1 KΩ |
| Q1, Q2 | 700 V, 5A (MJE13005) |
| Q3 | TIP-41, -41A, -41B or -41C |
| Q4 | 2N4401 |
| U1 | LM324N(Quad Op Amp 14 pinDIP) |
| MOV1 | 150 VAC, 7.0 j |
| MOV2 | 360 VDC, 7.0 j |
| MOV3 | 240 VDC, 7.0 j |
| SR1 | 3A, SG-220 (Surge Inrush |

-continued

Table Of Component Values Used In FIG. 1

| SYMBOL | VALUE |
|---|---|
| | Limiter) |
| F1 | 3A, 250 V(250 deg F. INT) |
| F2 | (Serpentine Trace Fuse) |
| L1 | 95–100 turns, 23.5 gage |
| L2 | 95–100 turns, 23.5 gage |
| L3 | 270–300 turns, 24 gage |
| L4 | 45 turns, 30 gage |
| P1 | 40 turns, 24 gage |
| P2 | 48 turns, 24 gage |
| P3 | 1 turn, 24 gage |
| P4 | 1 turn, 24 gage |
| S1 | 1100 turns, 39 gage (heavy build) |
| S2 | 1100 turns, 39 gage (heavy build) |

Figure 2:
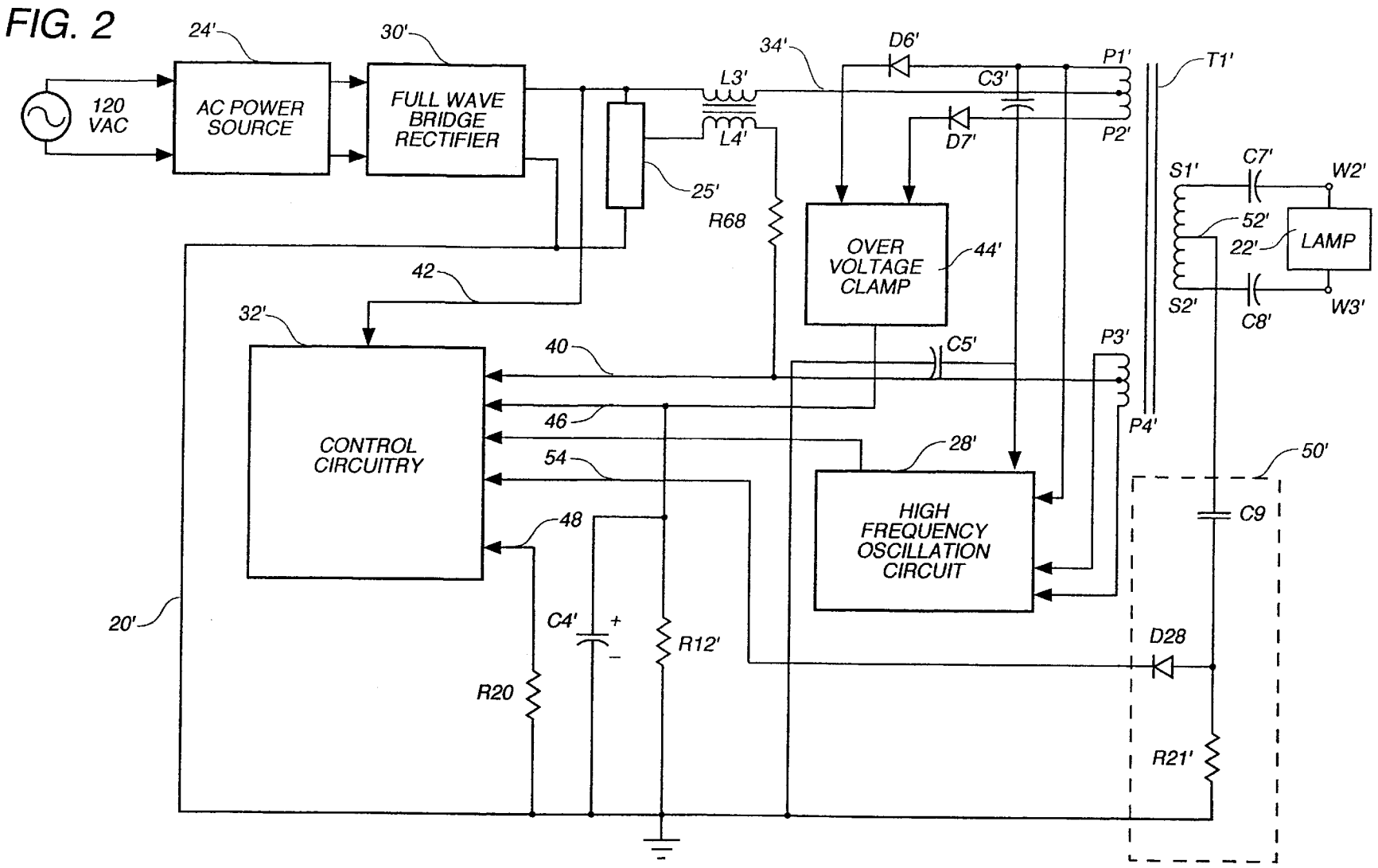
FIG. 2 is a schematic circuit diagram of a second embodiment of the neon driver ballast circuitry.

The embodiment shown in FIG. 2 is a schematic block diagram representation of the ballast circuit shown in FIG. 1 with an alternative monitoring circuit for detecting significant current imbalances with respect to the secondary load. The ballast circuit of FIG. 2 includes a DC power source, control circuitry, transformer section, oscillation transistor section, and output section.

Ballast circuit 20' accepts AC power source 24' and rectifies the signal by full wave bridge rectifier 30'. The resulting rectified and filtered DC power source is coupled to current choke inductor L3' and is supplied along current path 34' to the primary windings of ballast transformer T1'. Secondary choke inductor L4' is coupled to current choke inductor L3' and steps down the DC power source through start-up section 26' to provide a reduced power source to power control circuitry 32' at input 40.

Control circuit 32' monitors the DC power source via undervoltage lockout input 42 whereby ballast circuit operation is precluded upon sensing an insufficient source of power being supplied to the primary windings of ballast transformer T1'. Where the voltage across the primary windings exceeds the threshold limit of overvoltage clamp 44', then current flows to circuit ground. Coupled to overvoltage clamp 44' is resistor R12' which, upon developing an excessive voltage level, may reset control circuit 32' through input 46 and interrupt ballast circuit operation. As current flows through the primary side of transformer T1', oscillation circuit 28', and control circuitry 32', resistor R20' develops a voltage signal which is introduced to control circuit 32' at input 48. Upon the occurrence of an undercurrent condition, the voltage developed across resistor R20' is sufficient to set control circuit 32' and thereby interrupt ballast circuit operation.

Transformer T1' is comprised of windings P1' through P4', S1' and S2', and a ferrite core possessing characteristics such that the primary and secondary windings are tightly coupled resulting in a double parallel resonant circuit. This tight coupling allows for reliable sensing of the secondary load conditions on the primary side.

Secondary side load current imbalance monitoring circuit 50' includes DC isolation capacitor C9, diode D28, and resistor R21. Capacitor C9 and resistor R21' are coupled between center tap 52' of secondary windings S1 and S2 and circuit ground. If the load is reasonably balanced, e.g., plus or minus 20% with respect to circuit ground, then insufficient current flows through resistor R21 to develop sufficient voltage to set control circuit 32 at input 54. In the event of a major current imbalance, resistor R21 generates sufficient voltage to set control circuit 32' at input 54. Once control circuit 32' is set, the power transistor arrangement of high frequency oscillation circuit 28' is placed in a non-conducting state thereby disallowing current flow through the primary windings.

Feedback windings P3' and P4' provide high frequency oscillation circuit 28' with a feedback signal inversely (i.e., anti-phase) corresponding to the voltage apparent at the primary windings. This feedback winding alternately switches the transistor arrangement found within oscillation circuit 28' to a conducting state, thereby allowing primary winding current to pass through oscillation circuit 28' to circuit ground.

The frequency of oscillation circuit 28' is determined by primary side capacitor C3' in parallel with the primary windings. These elements acting in parallel resonate the collector(s) of the oscillator transistor(s) associated with oscillation circuit 28'. Windings P3' and P4' provide feedback to the base(s) of the oscillator transistor(s) associated with oscillation circuit 281. Windings S1' and S2' provide high voltage sine waveform to output resonating capacitors C7' and C8' and the load at outputs W2' and W3'. Output windings S1' and S2' are connected in series to resonating capacitors C7' and C8' and in series with the load resulting in gas discharge lamp 22' being an element in the resonant ballast circuit.

In order to avoid the formation of bubbles within the gas filled tubes, that is to avoid degrading the appearance of the lamps due to standing waveforms, an even order harmonic distortion is introduced to the output waveform. This is achieved by causing an imbalance on the primary windings of transformer T1'. This imbalance can be created by any of several different means including but not limited to: clipping, clamping, and alternating voltages. In the preferred embodiment, capacitor C5' is connected between the primary windings and common to achieve the desired unbalancing. This imbalance results in distorted sine waves. One half-cycle will be slightly longer with slightly lower peak voltage than the other. The mathematics associated with this relationship were recited hereinbefore. This results in a similar distortion in the current flowing through gas discharge lamp 22'. The gas inside the tube is very sensitive to this distortion such that it results in a constant flow of ionized gas toward one end or the other. This dispersion of standing waves serves to inhibit the formation of bubbles within the lamp tube.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A power supply device for a gas-filled arc-type lamp comprising:

a transformer having a core with a primary side and a secondary side;

a power source coupled to said primary side of said transformer core;

oscillating means for generating a full-wave generally sinusoidal signal, said oscillating means coupled to said primary side of said transformer;

means for connecting said secondary side of said transformer to the gas-filled arc-type lamp;

means for introducing even order harmonic distortion on said generally sinusoidal signal on said primary side of said transformer and generating a generally sinusoidal distorted signal on said secondary side of said transformer whereby a flow of ionized gas is created within the gas-filled arc-type lamp to disperse any bubbles and standing waves in the lamp, the distorted signal having one half-cycle longer with a lower peak voltage than another half-cycle, said another half-cycle having one half-cycle shorter with a higher peak voltage than said one half-cycle;

control means for controlling said oscillating means, said control means comprises switching transistors and an op-amp network including a set/reset flip-flop, adapted to drive said switching transistors toward their respective conducting states, said op-amp network includes current imbalance monitoring means for monitoring output load current imbalances, said current imbalance monitoring means including a resistive element coupled between a center tap of said secondary winding of said transformer and circuit around, said resistive element being coupled to said flip-flop and generating a voltage signal sufficient to set said flip-flop and thereby de-energize said power supply upon the occurrence of a major current imbalance;

current choking means for coupling said primary side of said transformer to said power source; and secondary choking means for providing power to said control means, said secondary choking means being operatively associated with said current choking means.

2. The power supply of claim 1 wherein said secondary choking means comprises an inductor coil arranged to provide a stepped down bias power to said control means whereby said secondary choking means powers said control means resulting in reduced temperature rise and reduced power consumption within said control means.

3. The power supply of claim 1 wherein said op-amp network includes undervoltage lockout means for monitoring said power source and deactivating said oscillating means upon sensing insufficient power being supplied to said transformer.

4. The power supply of claim 1 wherein said op amp network includes underload limiting means for sensing current passing through said primary side of said transformer, said underload limiting means including a resistive element connected to the input of said op amp network such that the output of said op amp network sets said flip-flop and thereby deactivates said oscillating means upon the occurrence of insufficient primary winding current flow.

5. The power supply of claim 1 wherein said control means selectively biases said switching transistors bases toward their respective conducting states thereby permitting current flow through said oscillating means and said transformer.

6. The power supply of claim 1 further comprising feedback means for generating feedback signals to alternately activate said oscillating means, said feedback means being coupled to said transformer and comprising a center tapped feedback winding.

7. The power supply of claim 6 wherein said oscillating means comprises power transistors, and said power transistors are alternately driven to their respective conducting states by said feedback signals in a push/pull manner.

8. The power supply of claim 7 further comprising second means for introducing feedback to said power transistor bases.

9. A power supply device for a gas-filled arc-type lamp comprising:

a transformer having a core with a primary side and a secondary side;

a power source coupled to said primary side of said transformer core;

oscillating means for generating a full-wave generally sinusoidal signal, said oscillating means coupled to said primary side of said transformer;

means for connecting said secondary side of said transformer to the gas-filled arc-type lamp;

means for introducing even order harmonic distortion on said generally sinusoidal signal on said primary side of said transformer and generating a generally sinusoidal distorted signal on said secondary side of said transformer whereby a flow of ionized gas is created within the gas-filled arc-type lamp to disperse any bubbles and standing waves in the lamp, the distorted signal having one half-cycle longer with a lower peak voltage than another half-cycle, said another half-cycle having one half-cycle shorter with a higher peak voltage than said one half-cycle;

feedback means for generating feedback signals to alternately activate said oscillating means, said feedback means being coupled to said transformer and comprising a center tapped feedback winding, said oscillating means comprises power transistors alternately driven to their respective conducting states by said feedback signals in a push/pull manner; and second means for introducing feedback to said power transistor bases, said feedback means includes two resonating capacitors coupled to the gas discharge lamp and said secondary side.

* * * * *